US009302169B2

(12) United States Patent
Lee

(10) Patent No.: US 9,302,169 B2
(45) Date of Patent: Apr. 5, 2016

(54) GOLF PUTTER PRACTICE DEVICE

(71) Applicant: Jeong Soo Lee, Diamond Bar, CA (US)

(72) Inventor: Jeong Soo Lee, Diamond Bar, CA (US)

( * ) Notice: Subject to any disclaimer, the term of this patent is extended or adjusted under 35 U.S.C. 154(b) by 0 days.

(21) Appl. No.: 14/289,297

(22) Filed: May 28, 2014

(65) Prior Publication Data

US 2014/0357394 A1 Dec. 4, 2014

Related U.S. Application Data

(60) Provisional application No. 61/829,069, filed on May 30, 2013.

(51) Int. Cl.

| | |
|---|---|
| ***A63B 69/36*** | (2006.01) |
| ***A63B 53/06*** | (2015.01) |
| *A63B 53/04* | (2015.01) |

(52) U.S. Cl.

CPC ..... *A63B 69/3685* (2013.01); *A63B 53/06* (2013.01); *A63B 2053/0441* (2013.01)

(58) Field of Classification Search

CPC ..... A63B 53/06; A63B 2053/0441; A63B 69/3685

USPC ..... 473/236; D21/791

See application file for complete search history.

(56) References Cited

U.S. PATENT DOCUMENTS

| | | | | |
|---|---|---|---|---|
| 3,489,415 | A * | 1/1970 | Smith | 473/236 |
| 5,135,228 | A * | 8/1992 | Hawkins et al. | 473/236 |
| 5,441,268 | A * | 8/1995 | Shier | 473/236 |
| 5,533,728 | A * | 7/1996 | Pehoski | A63B 53/0487 473/252 |
| 6,780,119 | B1 * | 8/2004 | Gankas | 473/236 |
| 6,821,212 | B2 * | 11/2004 | Fowler et al. | 473/236 |
| D548,809 | S * | 8/2007 | Walsh | D21/791 |
| 8,162,773 | B1 * | 4/2012 | Pingalore | A63B 69/3685 33/501 |
| 2003/0134686 | A1 * | 7/2003 | Arkley et al. | 473/236 |
| 2006/0135278 | A1 * | 6/2006 | Lee | 473/236 |
| 2006/0183562 | A1 * | 8/2006 | Hill | 473/236 |
| 2007/0293335 | A1 * | 12/2007 | Walsh | 473/236 |

* cited by examiner

*Primary Examiner* — Sebastiano Passaniti

(57) ABSTRACT

A golf putter practice device for practicing repetitive ball striking develops consistent contact on an optimal position on the striking surface of a putter. The device includes a body having a top surface, a front surface, and a channel extending through the body. The channel receives a flange of the putter therein whereby the front surface of the body covers a striking surface of the putter. Alignment indicia transverse to the channel is positioned on the top surface of the body. The alignment indicia has a front section abutting and extending rearwardly from a junction of the top surface with the front surface. A fastener is coupled to the body for securing the body on the putter.

11 Claims, 4 Drawing Sheets

GOLF PUTTER PRACTICE DEVICE

CROSS-REFERENCE TO RELATED APPLICATIONS

This application claims benefit of the provisional application No. 61/829,069 filed May 30, 2013.

BACKGROUND OF THE DISCLOSURE

1. Field of the Disclosure

The disclosure relates to putter practice devices and more particularly pertains to a new putter practice device for practicing repetitive ball striking to develop consistent contact on an optimal position on the striking surface of a putter.

2. Summary of the Disclosure

An embodiment of the disclosure meets the needs presented above by generally comprising a body having a top surface, a front surface, and a channel extending through the body. The channel receives a flange of the putter therein whereby the front surface of the body covers a striking surface of the putter. Alignment indicia transverse to the channel is positioned on the top surface of the body. The alignment indicia has a front section abutting and extending rearwardly from a junction of the top surface with the front surface. A fastener is coupled to the body for securing the body on the putter.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
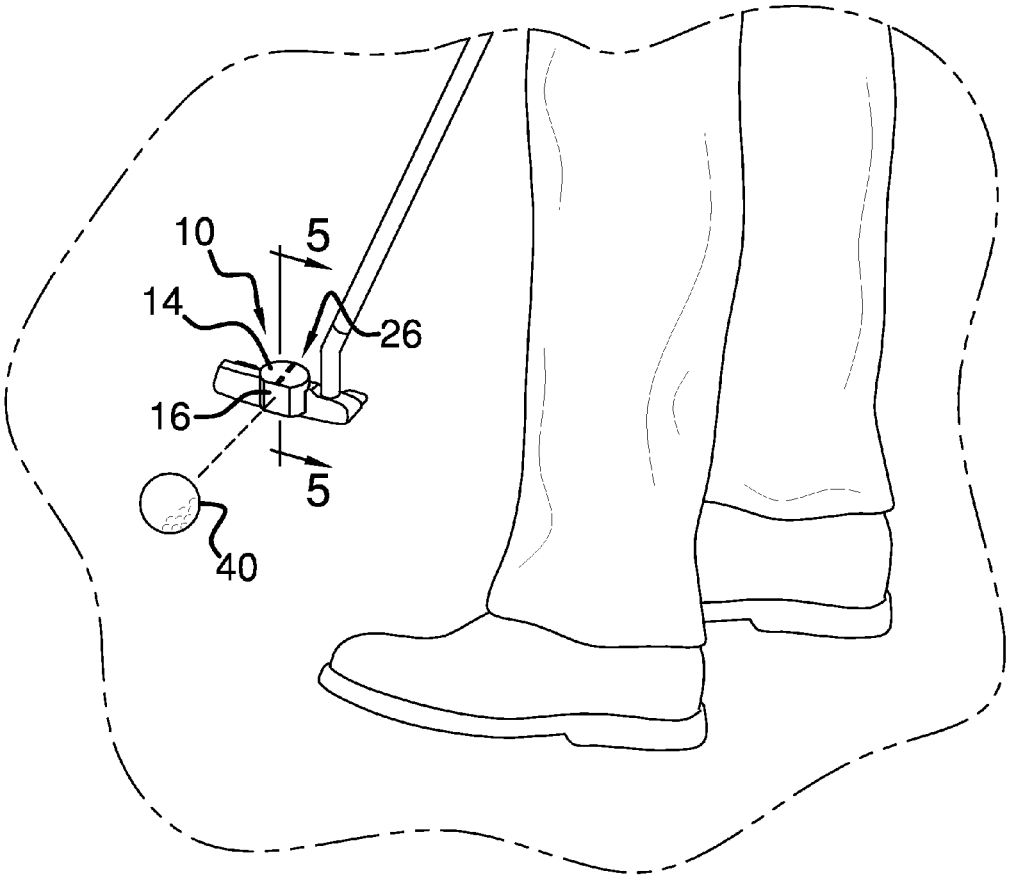
FIG. 1 is a top front side perspective view of a golf putter practice device according to an embodiment of the disclosure.
Figure 2:
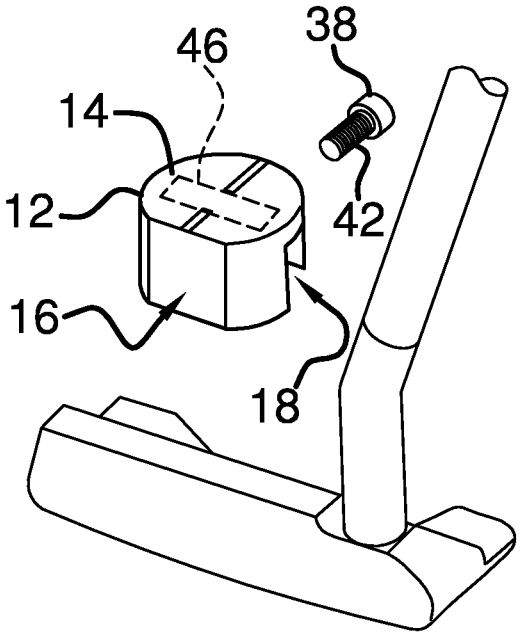
FIG. 2 is an exploded top front side perspective view of an embodiment of the disclosure.
Figure 3:
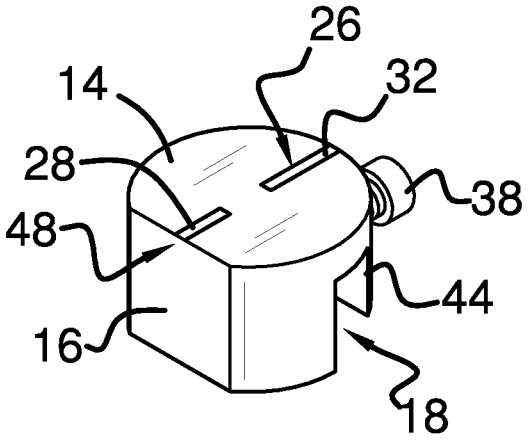
FIG. 3 is a top front side perspective view of an embodiment of the disclosure.
Figure 4:
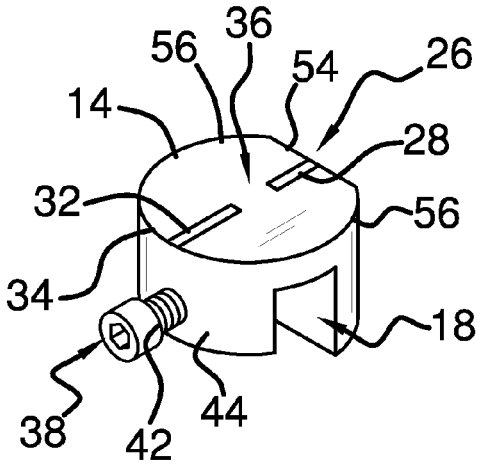
FIG. 4 is a top back side perspective view of an embodiment of the disclosure.

With reference now to the drawings, and in particular to FIGS. 1 through 9 thereof, a new putter practice device embodying the principles and concepts of an embodiment of the disclosure and generally designated by the reference numeral 10 will be described.

Figure 5:
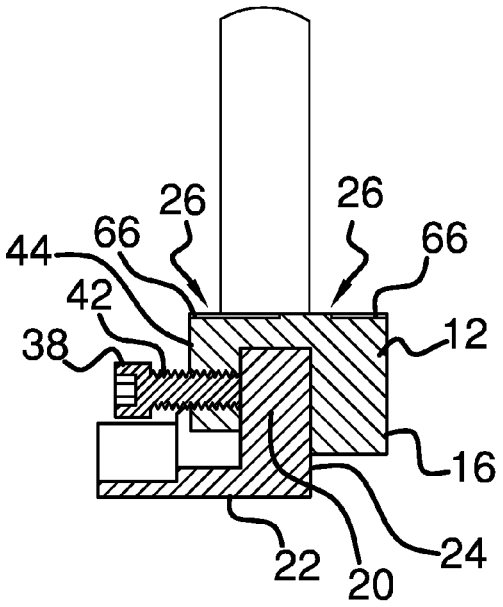
FIG. 5 is a cross-sectional view of an embodiment of the disclosure taken along line 5-5 of FIG. 1.
Figure 6:
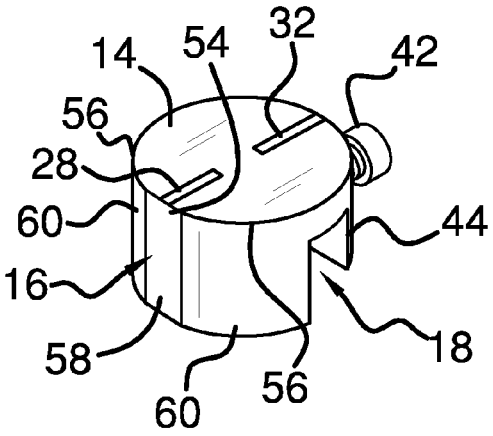
FIG. 6 is a top front side perspective view of an embodiment of the disclosure.

As best illustrated in FIGS. 1 through 9, the golf putter practice device 10 generally comprises a body 12 having a top surface 14, a front surface 16, and a channel 18 extending through the body 12. The channel 18 is configured for receiving a flange 20 of a putter 22 therein. Thus, the front surface 16 of the body 12 covers a striking surface 24 of the putter 22. Alignment indicia 26 is positioned on the top surface 14 of the body 12. The alignment indicia 26 has a straight front section 28 abutting and extending rearwardly from a junction 30 of the top surface 14 with the front surface 16. The alignment indicia 26 may further comprise a straight back section 32 extending forwardly from a back edge 34 of the top surface 14 and extending over said channel 18. The front section 28 and the back section 32 are aligned and may define a gap 36 therebetween. The alignment indicia 26 is transverse to the channel 18 and aligned with a center 48 of the top surface 14 of the body 12. As seen in FIG. 5, the alignment indicia 26 may be produced by a groove 66 extending into the top surface 14. The channel 18 is visible through the top surface 14 such that the body 12 is configured for permitting viewing of an alignment mark on the flange 20 of the putter 22 facilitating proper positioning of the body 12 on the flange 20.

A fastener 38 is coupled to the body 12. The fastener 38 is positionable such that the fastener 38 is configured for securing the body 12 on the putter 22 allowing a person to solidly strike a golf ball 40 on the front surface 16 by swinging of the putter 22. The fastener 38 may be a bolt 42 or a screw. An insert, not shown, may be used to enhance thread durability. The bolt 42 is extendable through a back section 44 of the body 12 and into the channel 18 wherein the bolt 42 urges the body 12 into frictional engagement with the flange 20 of the putter 22. Alternatively, the fastener 38 may be a strip 46 of adhesive material. The strip 46 of adhesive material is positioned within the channel 18 wherein the body 12 is configured for adhering to the flange 20 of the putter 22. The body 12 may also be secured to the putter 22 in another conventional manner.

Figure 7:
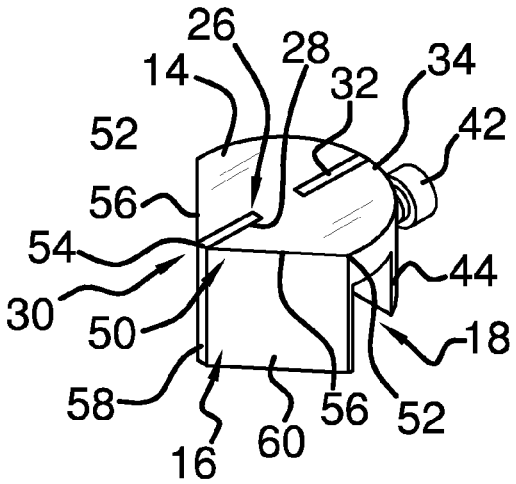
FIG. 7 is a top front side perspective view of an embodiment of the disclosure.

A front edge 50 of the top surface 14 is coextensive with the front surface 16 of the body 12. The front surface 16 of the body 12 is transverse to the top surface 14 extending between opposite lateral edges 52 of the front surface 16. In embodiments shown in FIGS. 1 through 7, the front edge 50 comprises a medial extent 54 parallel to the channel 18 and a pair of outer extents 56. Each of the outer extents 56 extends outwardly and rearwardly away from the medial section 54. The medial extent 54 of the front edge 50 defines a medial section 58 of the front surface 16. Similarly, the outer extents 56 define outer sections 60 of the front surface 16. The medial section 58 is planar. The outer sections 60 of the front surface 16 may each be planar as shown in FIG. 7. Alternatively, the outer sections 60 may each arcuate as shown in FIGS. 1 through 6.

The medial section 58 of the front surface 16 has a width between 2 millimeters and 30 millimeters. The wider the medial section 58, the easier it will be to keep the golf ball 40 near the intended path when the medial section 58 strikes the ball 40 imprecisely.

Figure 8:
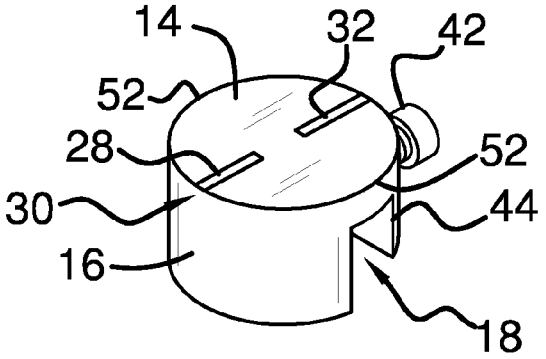
FIG. 8 is a top front side perspective view of an embodiment of the disclosure.
Figure 9:
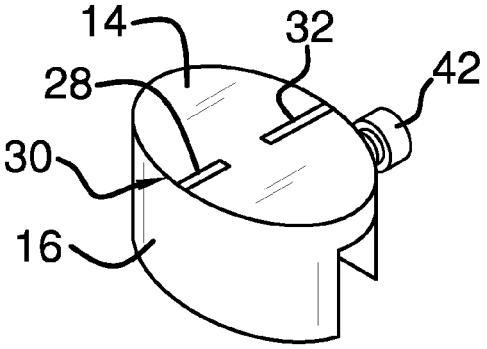
FIG. 9 is a top front side perspective view of an embodiment of the disclosure.

In embodiments represented in FIGS. 8 and 9, the front edge 50 may have a continuous curve. As shown in FIG. 8, the front edge 50 may be semi-circular requiring a precise alignment swinging of the putter 22 to propel the golf ball 40 on a desired path. Improperly aligned shots will be propelled off of the intended path to give immediate feedback. The front edge 50 may be parabolic to provide either less or more dramatic departure from the intended path when the golf ball 40 is struck off center of the front surface 16.

In use, the device 10 is positioned on the flange 20 of the putter 22. The putter 22 is then used in a normal fashion to strike the golf ball 40. The device 10 is used repetitively for practice. The device 10 requires enhanced precision in the alignment and swing of the putter 22 to develop a more consistent and reliable putting stroke during game play. Each shape of the device 10, compared to viewing the flange 20 of the putter 22 alone, enhances confidence of the user when swinging the putter 22 alone because the shape of the device 10 generally appears more difficult to use to strike the golf ball 40 along the intended path.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A golf putter practice device for coupling to a putter, the device comprising:

a body having a top surface, a front surface, and a channel extending through said body, said channel being configured for receiving a flange of the putter therein whereby said front surface of said body covers a striking surface of the putter, wherein said channel is visible through said top surface such that said body is configured for permitting viewing of an alignment mark on the flange of the putter;

a fastener coupled to said body, said fastener being positionable wherein said fastener is configured for securing said body on the putter; and alignment indicia positioned on said top surface of said body, said alignment indicia being transverse to said channel, said alignment indicia having a front section abutting and extending rearwardly from a junction of said top surface with said front surface, said alignment indicia having a back section aligned with said front section, said back section extending over said channel and being spaced from said front section wherein said back section is configured for being viewed adjacently positioned to the alignment mark on the flange of the putter through said top surface.

2. The device of claim 1, further comprising said alignment indicia being aligned with a center of said top surface of said body.

3. The device of claim 1, further comprising a front edge of said top surface being coextensive with said front surface of said body, said front surface of said body being transverse to said top surface, said front edge being semi-circular.

4. The device of claim 1, further comprising a front edge of said top surface being coextensive with said front surface of said body, said front surface of said body being transverse to said top surface, said front edge being parabolic.

5. The device of claim 1, further comprising a front edge of said top surface being coextensive with said front surface of said body, said front surface of said body being transverse to said top surface, said front edge comprising a medial extent parallel to said channel and a pair of outer extents, each of said outer extents extending outwardly and rearwardly away from said medial extent.

6. The device of claim 5, further comprising said medial extent defining a medial section of said front surface, said medial section of said front surface being planar.

7. The device of claim 5, further comprising said outer extents defining respective outer sections of said front surface, said outer sections of said front surface each being planar.

8. The device of claim 5, further comprising said outer extents defining respective outer sections of said front surface, said outer sections of said front surface each being arcuate.

9. The device of claim 1, further comprising said front surface of said body having a rectangular medial section, a width of said medial section being between 2 millimeters and 30 millimeters.

10. The device of claim 1, further comprising said fastener being a bolt, said bolt being extendable through a back section of said body and into said channel wherein said bolt urges the body into frictional engagement with the flange of the putter.

11. The device of claim 1, further comprising said fastener being a strip of adhesive material, said strip of adhesive material being positioned within said channel wherein said body is configured for adhering to the flange of the putter.

* * * * *